US005638778A

United States Patent [19]

James

[11] Patent Number: 5,638,778

[45] Date of Patent: Jun. 17, 1997

[54] OPPOSED PISTON SWASH PLATE ENGINE

[76] Inventor: Robert G. James, 2713 Vyn Dr., Bakersfield, Calif. 93306

[21] Appl. No.: 568,202

[22] Filed: Dec. 6, 1995

[51] Int. Cl.[6] ..... F02B 75/26

[52] U.S. Cl. ..... 123/56.6

[58] Field of Search ..... 123/56.3, 56.6, 123/71 R

[56] References Cited

U.S. PATENT DOCUMENTS

| | | | |
|---|---|---|---|
| 1,894,033 | 1/1933 | Farwell | 123/56.6 |
| 1,895,206 | 1/1933 | Ricardo | 123/56.6 |
| 2,565,272 | 8/1951 | Sherman | 123/56.6 |
| 3,536,050 | 10/1970 | Denis | 123/56.6 |
| 4,285,303 | 8/1981 | Leach | 123/56.6 |
| 4,905,637 | 3/1990 | Ott | 123/56.6 |
| 4,986,226 | 1/1991 | Lacy | 123/56.6 |

FOREIGN PATENT DOCUMENTS

| | | | |
|---|---|---|---|
| 594192 | 5/1959 | Italy | 123/56.6 |
| WO 87/00243 | 1/1987 | WIPO | 123/56.6 |

*Primary Examiner*—David A. Okonsky

[57] ABSTRACT

An opposed piston internal combustion engine includes a rotary shaft provided with a first and second swash plate, each inlined relative the axis of the shaft at equal but opposite inclinations. The shaft is mounted for rotation in a frame on which at least one cylinder is fixed in parallel alignment. A first set of pistons on the ends of a tubular post is fitted in the cylinder with a central rod extending coaxially through the post and the first piston set. A second set of pistons is then fixed to the ends of the rod. Both the rod and the post engage the respective swash plate peripheries, and are thus reciprocated in opposition as the shaft is turned. In this manner the gas mixture between the piston sets at one end is compressed while the mixture at the other end is ignited.

10 Claims, 3 Drawing Sheets

OPPOSED PISTON SWASH PLATE ENGINE

BACKGROUND OF THE INVENTION

1. Field of the Invention

The present invention relates to internal combustion powerplants, and more particularly to swash plate articulated engines conformed for opposed piston reciprocation.

2. Description of the Prior Art

An internal combustion engine derives its power from the volumetric compression of a gas mixture prior to its ignition. This volumetric change is most often effected by reciprocating pistons which in the course of each stroke vary the gas volume captured in a cylinder. The reciprocal piston motion thus effects the gas compression and also the intake of the next gas charge and its exhaust following ignition.

Heretofore, it has been the prevailing practice to tie the pistons to a rotary crankshaft in order to convert the reciprocal power into rotation. The automotive engine is a prime example of this approach, now reaching the limits of its full development. Crank articulated powerplants, however, entail inherent characteristics of the cranck mechanism associated with the required connecting rod, which result in lateral force components resolved at the piston to cylinder wall interface. Also associated with the cranck mechanism are the centrifugal loads of the rod end tied to the crank, and the connecting rod bending modes compounded by the crank dynamics. These have combined to limit the shaft rotation rate, thus limiting the power levels of the engine. The power to weight density is therefore approaching its inherent limits.

In the past an alternative form of an internal combustion engine has been devised, generally based on a swash or wobble plate mounted on a rotary shaft. Examples of such a power plant may be found in the teachings of U.S. Pat. Nos. 3,521,614 to Orkney; 1,613,116 to Michell; 1,885,323 to Duryea; and 1,407,047 to Trowbridge. In the engine structure of this type the displacement of the swash plate edge is connected to the reciprocal motion of the piston, thus converting directly the expansion of the ignited charge into shaft rotation. This particular mechanism obtains extensive simplifications in the component dynamics, eliminating the compound kinematic effects associated with cranck motion.

More importantly, the elimination of many of the lateral load components simplifies the piston to cylinder interface, allowing close tolerances therebetween to minimise parasitic losses that now entail complex sealing. A swash plate mechanism, therefore, obtains many advantages, and it is the improvement of this mechanism that is disclosed herein.

SUMMARY OF THE INVENTION

Accordingly, it is the general purpose and object of the present invention to improve the swash plate reciprocation mechanism for optimum power to weight density.

Other objects of the invention are to provide a coaxial, opposed piston combination engaged for swash plate articulation to effect the gas expansion following ignition.

Yet further objects of the invention are to provide a swash plate implemented reciprocal mechanism arranged in opposition, wherein the discharge in one chamber compresses the volume of the opposed chamber.

Briefly, these and other objects are accomplished within the present invention by providing an engine assembly in which two swash plates are fixed to a common output shaft, the angular displacement of one swash plate being generally opposite to the displacement6 of the other. A first set of opposed pistons, each fixed at one end of a common tubular connecting post is then engaged for reciprocal articulation by the first swash plate, while a second pair of opposed pistons fixed to the respective ends of a connecting rod received within the tubular post is articulated by the second swash plate. To accomodate the engagement of the connecting rod to the second swash plate, the tubular post is provided with a lateral cutout through which the engagement slide fixed to the rod extends. A similar slide fixed to the tubular post, offset axially from the rod slide, engages the edge of the first swash plate.

In this manner the tubular post and the coaxial rod are reciprocated in opposite directions by the common rotation of the shaft and the first and second swash plates mounted thereon. Thus as the proximate ends of the post and the rod are advanced towards each other, their opposite ends spread apart. A gas mixture charge compressed between the pistons on the proximate ends then, in the course of its expansion following ignition, compresses the fresh charge between the pistons on the opposite ends.

It should be noted that the foregoing arrangement results in load vectors that are substantially axial. Moreover, the summation of axial forces in the interior, smaller diameter, connecting rod is primarily in tension, while the net load in the larger sectioned annular post is in compression. Thus the coaxial geometry of this novel arrangement produces synergistically advantageous structures that inherently accomodate the operating stress components. Furthermore, since the forces are directly cancelled in the rod and post structure, the net output at the swash plates corresponds substantially to the net power produced.

Each of the foregoing piston combinations is received in a common cylinder structure provided with the necessary porting for receiving the gas charge and the porting for exhaust. The piston-cylinder assembly can then be repeated in multiple combinations around the common swash plate driven shaft, and by the expedient of multiplication can match the desired power levels of the end use.

The above example is particularly suited for two stroke power generation. Since the volume underneath the pistons is essentially fixed, the intake of the charging mixture may be effected by a screw supercharger driven by the output shaft and the charging process can be adjusted for the cylinder combinations by the expedient of adjusting the supercharger intake rate. The rod connected pistons can then be those that open the discharge ports, while the intake ports in the cylinder are exposed by the pistons mounted on the post. The phasing between the piston sets can then be accomodated by adjusting the relative inclination azimuths of the first and second swash plates.

In each instance the peripheral edges of the swash plates are mounted in the interior races of corresponding roller bearings, each including an exterior race rounded in section and provided with a radial post captured in a spherical bushing received in each slide accomodating the motion therein. Thus the dominant losses to friction in each slide are reduced to those associated with thrust bearings.

DESCRIPTION OF THE PREFERRED EMBODIMENTS

Figure 1:
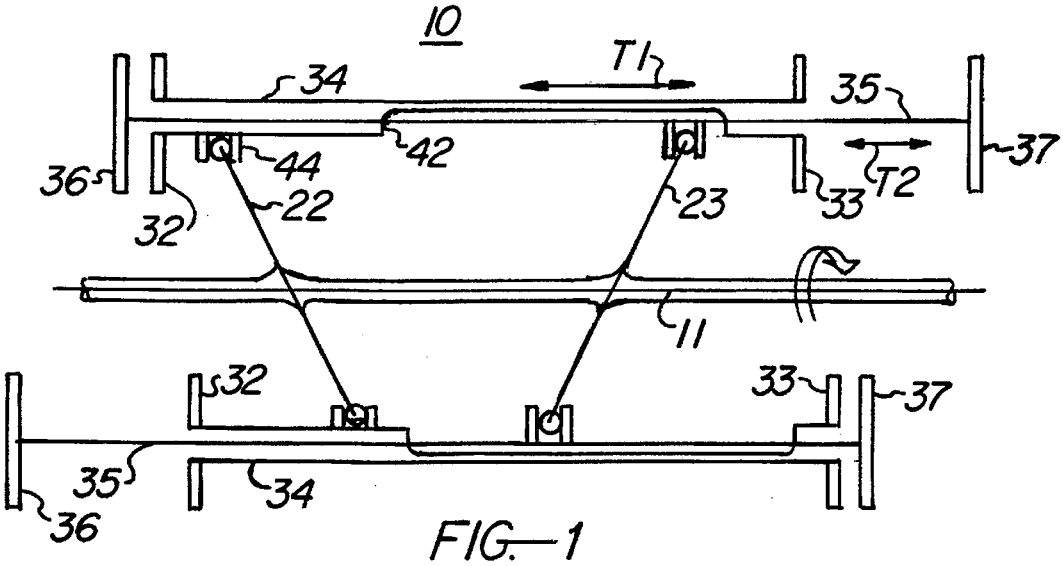
FIG. 1 is a diagrammatic illustration of the preferred example of the inventive coaxial piston combination engaged to a dual swash plate output shaft.
Figure 2:
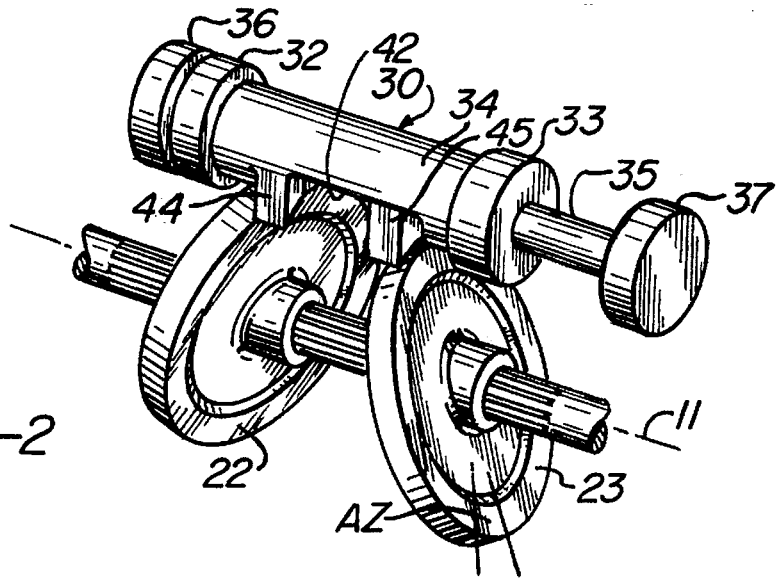
FIG. 2 is a perspective illustration of the inventive assembly illustrated diagrammatically in FIG. 1.
Figure 3:
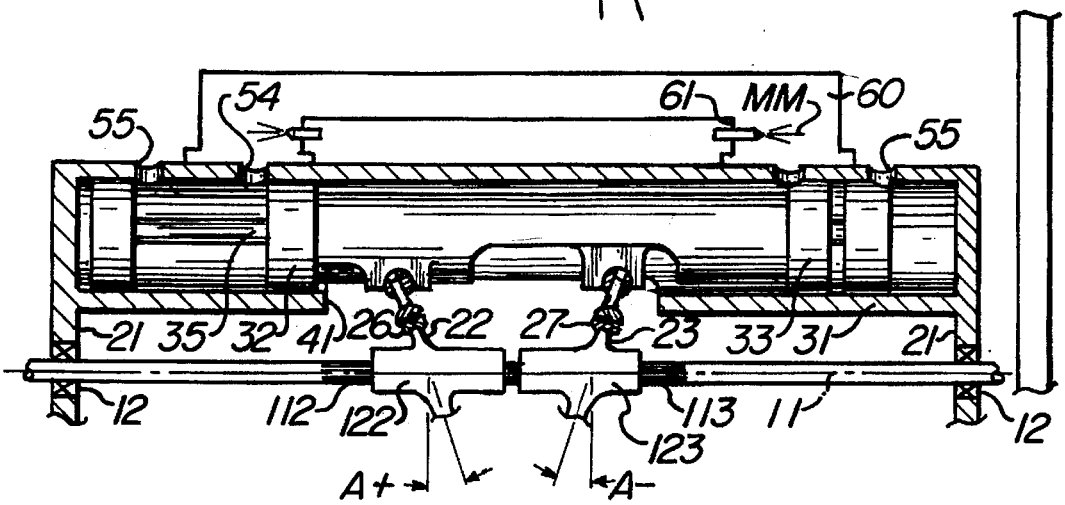
FIG. 3 is a sectional side view of the inventive assembly shown in FIG. 2, illustrating one operative engagement thereof.
Figure 4:
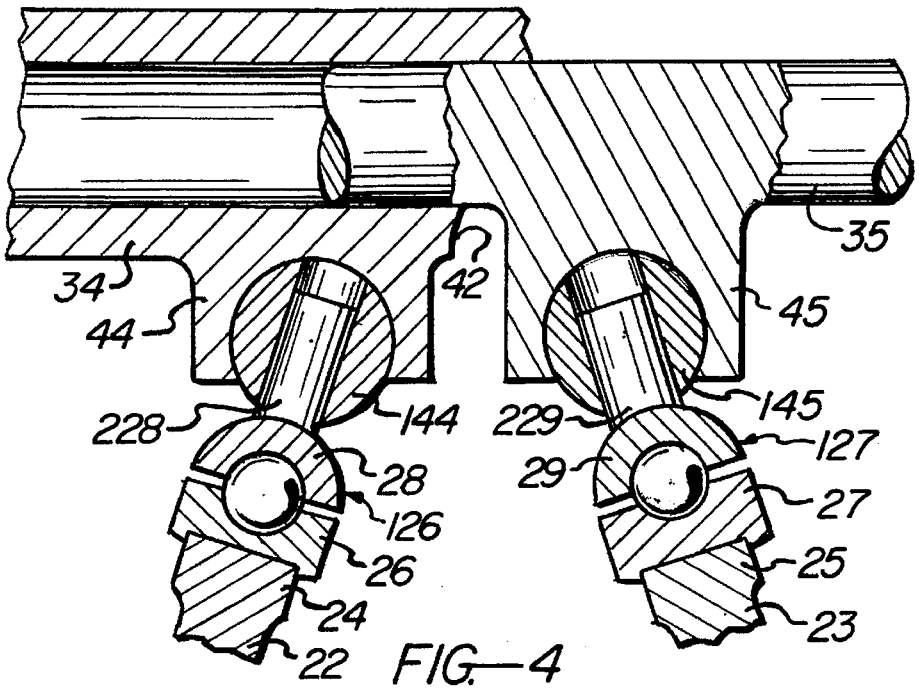
FIG. 4 is a detail view, in partial section, illustrating the engagement mechanism of the coaxial piston combination with a swash plate.

As shown in FIGS. 1–4 a first example of the inventive powerplant assembly, generally designated by the numeral 10, includes a rotary shaft 11 supported in bearings 12 and provided with a first and second wobble or swash plate 22 and 23, respectively. Swash plates 22 and 23 are each generally circular in planform and are each affixed to the shaft 11 at generally adjustable and substantially equal but opposite inclination angles A+ and A− from orthogonal relative the shaft axis. Thus as the shaft 11 is advanced in rotation, the periphery of plates 22 and 23, at any fixed azimuth, translate along the axis of rotation in opposite reciprocal translations shown by vectors T1 and T2. Each plate 22 and 23, moreover, is provided with an enlarged peripheral edge bead 24 and 25 which is received in the interior races 26 and 27 of corresponding circular bearings 126 and 127. Each bearing 126 and 127, furthermore, is provided with an exterior race 28 and 29 convolved at their exterior into circular sections. Radial posts 228 and 229, extending from the exterior races, are then captured in spherical bushings 144 and 145 respectively received in the fittings 44 and 45.

An opposed piston assembly, generally at 30, is aligned along an axis parallel to the axis of shaft 11, and includes a cylinder 31 in which a first set of pistons 32 and 33, at the ends of a tubular post 34, are received. A central rod 35 slidably extends coaxially through pistons 32 and 33 and the interior of the tubular post 34, attached at the ends to a second set of pistons 36 and 37. Both the cylinder 31 and the post 34 include corresponding cutouts 41 and 42 aligned towards the edges of the swash plates 22 and 23 through which corresponding lateral slides 44 and 45 project to engage in mating fit the respective outer races 28 and 29, slide 44 extending from post 34 and slide 45 extending from rod 35. Thus, as shaft 11 is driven in rotation, plates 22 and 23 articulate slides 44 and 45, in turn articulating post 34 and rod 35.

Plates 22 and 23 are each splined to the shaft 11 at inclined but generally opposed angles of inclination A+ and A−. Thus the resulting reciprocal articulation of the post 34 and rod 35 is also opposed and as piston 32 is separating from piston 36, pistons 33 and 37 are appraching each other. Any ignitable gas mixture compressed between the approaching pistons will then drive the swash plates in rotation while also compressing the captured volume between the pistons at the other ends of the post 34 and rod 35.

In consequence, the major components of force align axially, reducing wall wear and thereby permitting a substantially tighter fit between the cylinder walls and the pistons. Further axial force resolution is achieved by a honed and bushed axial receipt of rod 35 within post 34, and the relative dimension between the post ends and the slide cantelever.

Thus all the major force components resolve along the axis of motion, which also coincides with the axis of the gas expansion. This axial resolution of forces, moreover, effects cancellation directly in the structure of the post and rod, allowing for a large surface contact with the cylinder wall for effective heat transfer. As result, predictable heat gradients can be achieved which then lead to predictable ignition patterns, all desired end objects for efficient use of fuel.

A set of inlet ports 54 and outlet ports 55 at the ends of the cylinder 31 provide the necessary paths for receipt of the combustible mixture, and the exhausting of the spent products of combustion, respectively connecting to a turbocharger assembly 60 and an exhaust manifold 65. These may be implemented in known techniques, taking advantage of the well defined nature of the strokes and compression history, inlet ports 54 being uncovered by the pistons at the ends of post 34 while the piston set mounted on rod 35 opens the exhaust ports. This well controlled nature of the mechanism is particularly advantageous with two stroke operation, supercharger 60 taking the form of a screw turbocharger driven by shaft 11. Well known injection techiques, generally shown by injectors 61, then introduce the fuel mist MM into the supercharger output to ports 54.

Each of the swash plates 22 and 23 is provided with a central hub 122 and 123, splined for selective engagement on correspondingly formed spline segments 112 and 113 on shaft 11. Thus the azimuth AZ1 of the maximum inclination angle of swash plate 22 may be splined in a phased relationship with the azimuth AZ2 of swash plate 23. In this manner the phase angle of opening of the inlet ports 54 and that of the outlet ports 55 may be adjusted for maximum power.

Figure 6:
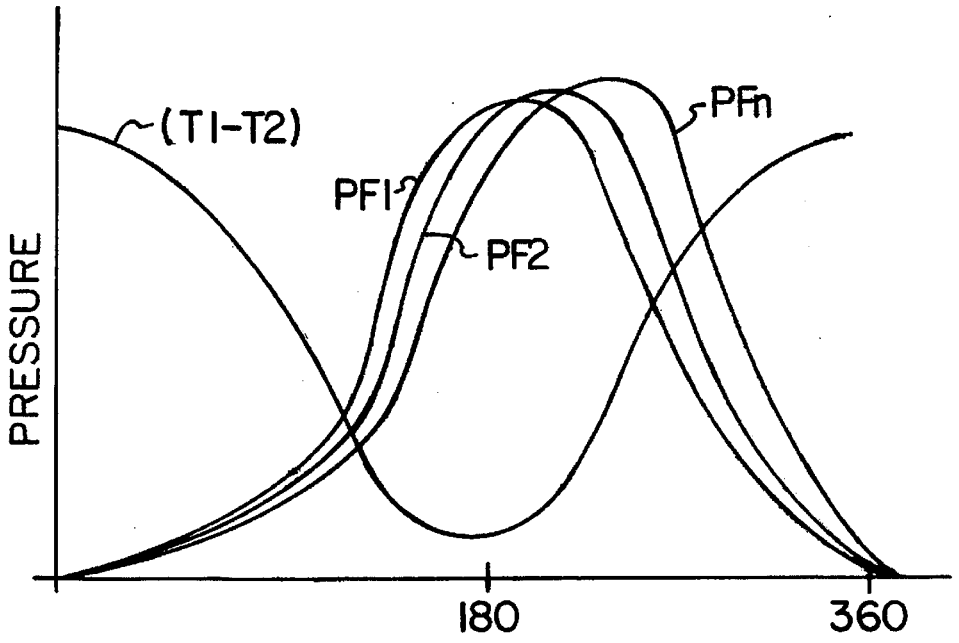
FIG. 6 is a graphical illustration of the reciprocal motion of the inventive piston sets in phased relationship.
Figure 7:
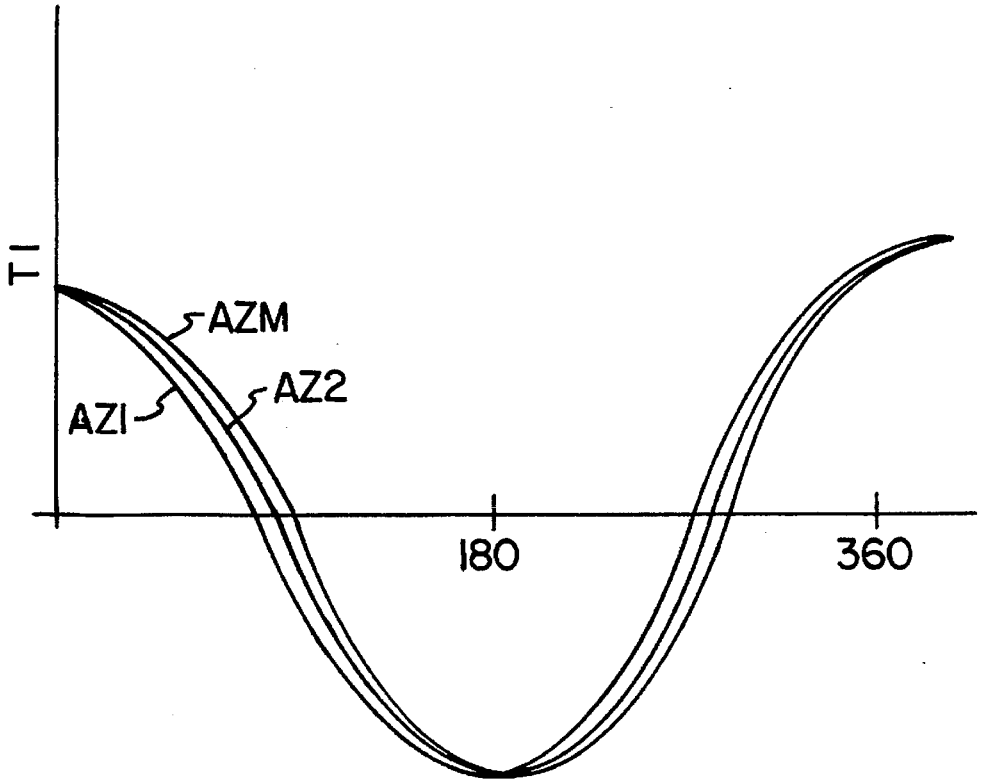
FIG. 7 is a pressure diagram with shaft rotation of the inventive coaxial piston combination.

By reference to FIGS. 6 and 7, the resulting vector history of vectors T1 and T2 with shaft angle SA results in a family of pressure functions PF1, PF2, through PFn, for each incremental azimuth difference between azimuths AZ1 and AZ2. The chamber pressures at each port opening can thus be conveniently modified by azimuth selection.

To reduce wall wear by the pistons a bushing may be fitted in post 34 and then honed for a close mating fit with rod 35. Similarly the interior of cylinder 31 may be honed for a mating fit with the pistons, thus allowing for the omission of any sealing rings. This linear resolution of the reciprocal motion, therefore, resolves the major current problems of engine wear.

One will note that the massive radial distrbution of the peripheral beads 24 and 25, on plates 22 and 23, increases the radial moment of inertia of the shaft assembly. Thus the swash plate arrangement also results in a structure that acts as a flywheel, at the operative center of the power plant. Since the swash plate loads are at their peak at the point of each ignition, the mass of the shaft assembly is determined by the compressive discharge of a single cylinder assembly 30. This aspect allows for convenient power multiplication by the simple expedient of multiples of the common cylinder assembly.

Figure 5A:
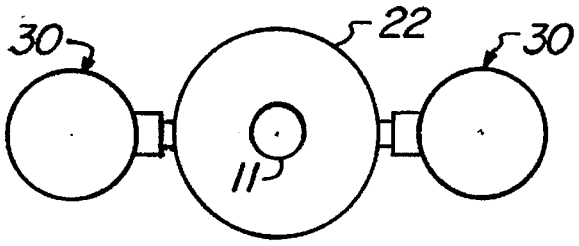
FIGS. 5*a*, 5*b*, and 5*c* are diagrammatic illustrations of selected multiple combinations of the inventive assemblies disclosed herein.
Figure 5B:
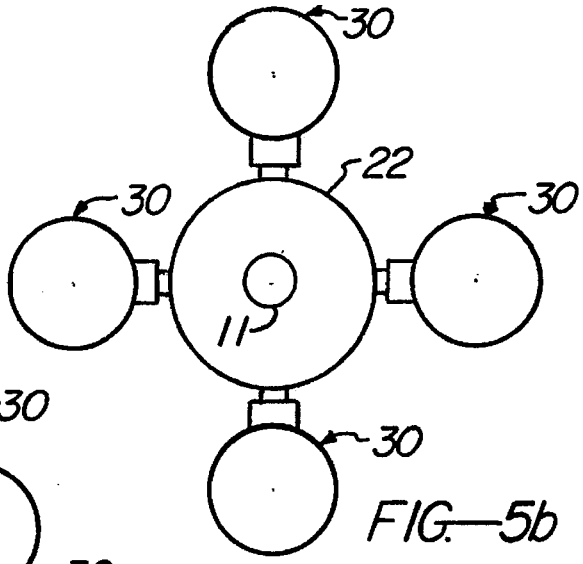
Figure 5C:
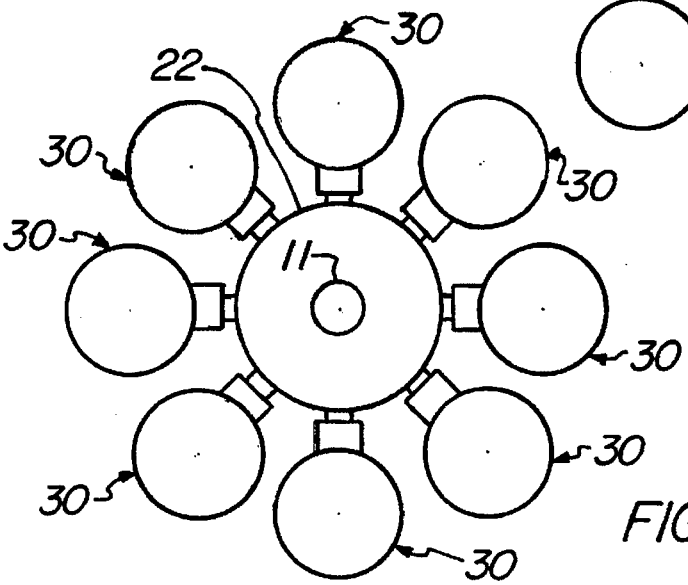

As illustrated in FIGS. 5*a*, 5*b*, and 5*c* a paired, quadrupled, and octal arrangement of the assemblies 30 around the periphery of the shaft 11 is conveniently effected, accomodating the desired power levels of the ultimate application.

Obviously many modifications and variations of the foregoing teachings may be made without departing from the spirit of the invention. It is therefore intended that the scope of the instant invention be determined solely by the claims appended hereto.

What is claimed is:

1. In an internal combustion engine characterised by a central rotary shaft, a frame supporting said shaft in rotation, intake means for receiving air from the surrounding atmosphere, and exhaust means for conveying the products of combustion therefrom, the improvement comprising:

a first swash plate of a generally circular planform mounted on said shaft at a first inclination from orthogonal relative the axis of said shaft;

a second swash plate of a generally circular planform mounted on said shaft at a second inclination from orthogonal relative the axis of said shaft;

a generally tubular cylinder mounted on said frame in a parallel alignment with the axis of said shaft;

a tubular post assembly received in said cylinder and including first pistons at the ends therof in mating fit with the interior of said cylinder;

a cylindrical rod received in said cylinder and extending through said post and said first pistons, said rod including second pistons at the ends thereof mated to said cylinder;

first means connected between said post and the periphery of said first swash plate; and second means connected between said rod and the periphery of said second swash plate.

2. Apparatus according to claim 1, further comprising:

supercharging means connected to said shaft and conformed to compress said air from said atmosphere and to convey same to said cylinder.

3. Apparatus according to claim 2, wherein:

said first and second swash plates are adjustably mounted on said shaft.

4. Apparatus according to claim 2, wherein:

said first and second swash plates are inclined at substantially opposite inclinations.

5. Apparatus according to claim 3, further comprising:

said first and second swash plates each include bearing around the peripheries thereof;

said first means includes a slide projecting from said post to engage said bearing on said first swash plate; and said second means includes a slide projecting from said rod to engage said bearing on said second swash plate.

6. An internal combustion engine, comprising:

a rotary shaft;

a frame supporting said shaft in rotation;

a first generally circular swash plate mounted on said shaft at an inclination from orthogonal relative the axis of said shaft;

a second generally circular swash plate mounted on said shaft at an inclination generally opposite to the inclination of said first swash plate;

a cylinder mounted on said frame generally parallel to said axis of said shaft;

a tubular post assembly received in said cylinder and including first pistons at the ends therof in mating fit with the interior of said cylinder;

a cylindrical rod received in said cylinder and extending through said post and said first pistons, said rod including second pistons at the ends thereof mated to said cylinder;

first means connected between said post and the periphery of said first swash plate; and second means connected between said rod and the periphery of said second swash plate.

7. Apparatus according to claim 6, further comprising:

supercharging means connected to said shaft and conformed to compress air from ambient atmosphere and to convey same to said cylinder.

8. Apparatus according to claim 7, wherein:

said first and second swash plates are adjustably mounted on said shaft.

9. Apparatus according to claim 7, wherein:

said first and second swash plates are inclined at substantially opposite inclinations.

10. Apparatus according to claim 8, further comprising:

said first and second swash plates each include bearing around the peripheries thereof;

said first means includes a slide projecting from said post to engage said bearing on said first swash plate; and said second means includes a slide projecting from said rod to engage said bearing on said second swash plate.

* * * * *